United States Patent [19]

Mendelsohn

[11] Patent Number: 4,843,281

[45] Date of Patent: Jun. 27, 1989

[54] GAS PLASMA PANEL

[75] Inventor: Charles Mendelsohn, Monsey, N.Y.

[73] Assignee: United Technologies Corporation, Hartford, Conn.

[21] Appl. No.: 919,938

[22] Filed: Oct. 17, 1986

[51] Int. Cl.[4] ..... H01J 17/49

[52] U.S. Cl. ..... 313/587; 313/586; 313/631; 313/633

[58] Field of Search ..... 313/561, 582, 586, 587, 313/567, 494, 540, 306, 307, 631, 633; 315/169.4

[56] References Cited

U.S. PATENT DOCUMENTS

| | | | |
|---|---|---|---|
| 3,818,258 | 6/1974 | Shirouchi et al. | 313/587 |
| 3,916,393 | 10/1975 | Criscimagna et al. | 313/587 |
| 4,028,578 | 6/1977 | Byrum, Jr. et al. | 313/587 |
| 4,053,804 | 10/1977 | Aboelfotoh | 313/587 |
| 4,198,585 | 4/1980 | Yamashita et al. | 313/587 |
| 4,317,061 | 2/1982 | Mendelsohn | 313/587 |
| 4,378,556 | 3/1983 | Wisnieff | 340/793 |
| 4,429,303 | 1/1984 | Aboelfotoh | 313/587 |
| 4,454,449 | 6/1984 | Hall | 313/584 |
| 4,517,492 | 5/1985 | Byrum, Jr. et al. | 313/587 |
| 4,731,560 | 3/1988 | Ernsthausen | 313/587 |

*Primary Examiner*—David K. Moore
*Assistant Examiner*—Mark R. Powell

[57] ABSTRACT

An improved gas plasma panel having an array of electrodes which define pixel points of light during gas ionization is disclosed wherein the wall charges generated at these pixel points during such ionization is concentrated about the pixel by the introduction of a dopant material onto the surface of the dielectric layer and in contact with the electron emissive layer.

5 Claims, 3 Drawing Sheets

FIG. 6
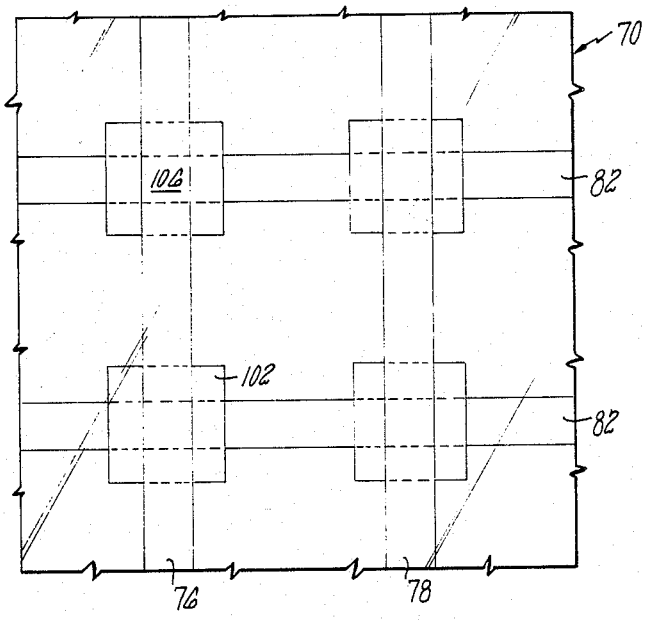
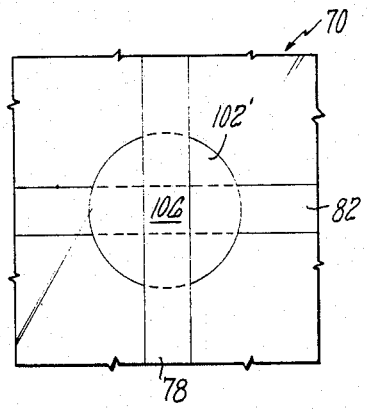
FIG. 7
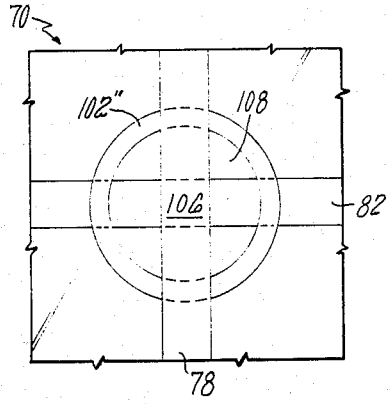
FIG. 8

GAS PLASMA PANEL

TECHNICAL FIELD

This invention pertains to electric lamps and discharge devices, in particular those devices having dielectric members.

BACKGROUND ART

Gas plasma display panels have been known for some years and typically comprise a mixture of two or more gases at a suitable gas pressure disposed in a transparent chamber or envelope. An array of electrodes are positioned on both sidewalls of the envelope, and each electrode is normally coated with a layer of dielectric material, which is itself coated with an electron emissive layer. The electrodes are arranged such that the electrodes on one sidewall are positioned substantially perpendicular to those on the other sidewall. The points at which one electrode on one sidewall is juxtaposed an electrode on the opposite sidewall results in a point at which they cross; this is known as the pixel point. During the operation of the plasma panel, an increased voltage pulse is applied to one of the electrodes creating a voltage differential across the gas envelope at a given pixel point. When the voltage is great enough, the gas between these electrodes at this point begins to ionize. The energy level at which this ionization occurs is called the write voltage ($V_w$).

During the gas ionization process, the gas, located between the pixel point electrodes, is stripped of at least one electron creating free electrons which are drawn to the positive electrode and positively charged gas ions which are drawn to the negatively charged cathode electrode. These free electrons collide with other gas atoms, on their path to the respective electrodes, causing an avalanche of effect of free electrons and ions, this being the plasma. As the positive ions are drawn to the cathode, they strike the emissive layer which coats the dielectric material disposed above the electrode at that pixel point. Upon striking the emissive layer, electrons are removed from the atoms of the emissive layer, some of which combine with the ionized gas forming neutral neon gas atoms and others which are drawn toward the anode. In this way, electrons are removed from the emissive layer creating a localized positive charge thereon. This positive charge is called a wall charge ($V_{wall}$). The significance of this wall charge is that at the next half cycle, when the cathode electrode becomes the anode electrode, the wall charge present at the pixel point will be cumulative to that voltage applied to the electrode, thereby lowering the voltage required to again ionize the gas to below that of the initial write voltage. This lower voltage is called the write sustain voltage ($V_{ws}$) and is the difference between the wall voltage and the write voltage. This is clearly set out mathematically as $$V_{ws}=V_w-V_{wall}$$

In the operation of these plasma panels, it is apparent that in order to maintain a low stable, repeatable write sustain voltage, it is desirable to maintain a high wall voltage. Unfortunately, during the generation of the wall charge on the emissive surface, electrons from the dielectric layer, below the cathode surface are electrostatically drawn through the thin cathode emissive surface layer to combine with the positive ions of the emissive layer and replace the diminishing supply of surface electrons. This migration of electrons causes the dielectric layer's surface to become positively charged. This charged surface then starts to spread along the entire surface of the dielectric layer due to charge dispersion forces and the ionic qualities, (i.e. contaminants, etc.) of the dielectric surface. The further away from the original energized pixel intersection site that the charge migrates within a given time period, the less positive charge within the pixel area will be available for the next half cycle when the fields reverse and the cathode becomes the anode. This ever-changing wall charge causes an ever-changing write sustain voltage requirement. In addition, as the charge spreads along the surface of the dielectric layer, it may alter the electrical state of neighboring pixels causing them to ignite prematurely.

Therefore, what is needed in this art, is a means to supply sufficient number of electrons to the emissive cathode surface, yet prevent the positive charge generated due to the loss of these electrons, from spreading along the surface of the dielectric layer. Such a means would lower and maintain the electrical requirements for each pixel to a normal and stable write sustain voltage as well as reduce crosstalk between neighboring pixels.

DISCLOSURE OF INVENTION

The present invention discloses a means for preventing charge spreading of the wall charges developed in a plasma display device at a given pixel point during ionization. The invention comprises introducing an electrically conductive dopant into the surface of the dielectric layer between and in contact with the cathode layer at each pixel point. The introduction of this dopant makes available a localized, easily accessible, source of electrons which may migrate through the emissive surface layer to replenish the electrons removed by the gas ionization process. This localized supply of electrons will concentrate the resulting positive charge within the implanted material, thereby preventing the charge from spreading along the surface of the dielectric material. The concentration of the charge within the dopant material's geographic region will maintain the wall charge at a high level, thereby reducing the write sustain voltage required to maintain the pixel in the "lit" or "on" position.

Other features and advantages will be apparent from the specification and claims and from the accompanying drawings which illustrate an embodiment of the invention.

BRIEF DESCRIPTION OF THE DRAWINGS

FIG. 6 is a view of a particular configuration of the dopant material about a pixel point where the dopant is in a square shape.

FIG. 7 is a view of a particular configuration of the dopant material about a pixel point in which the dopant is in the form of a disk.

FIG. 8 is a view of a particular configuration of the dopant material about a pixel point in which the dopant material is in the form of an arc about the pixel point.

BEST MODE FOR CARRYING OUT THE INVENTION

Figure 1:
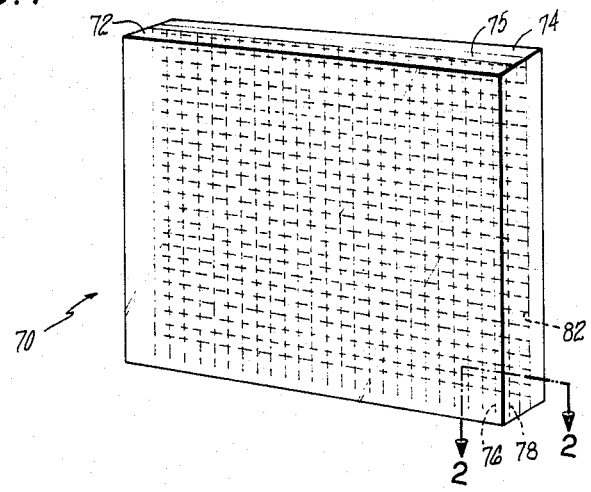
FIG. 1 is a view of a conventional A/C plasma panel.
Figure 2:
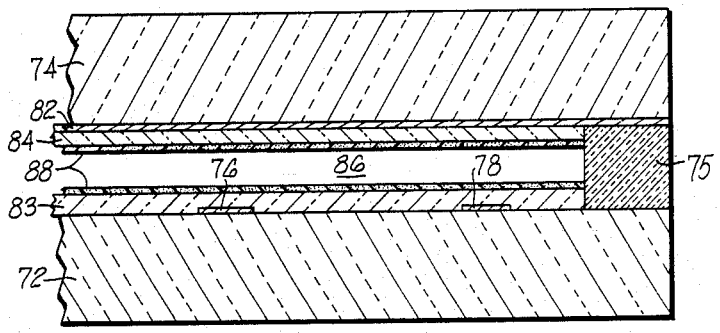
FIG. 2 is a partial cross-sectional view of FIG. 1 showing the internal arrangement of a plasma panel.

Referring now to FIG. 1 which is a typical embodiment of an AC plasma display device. The plasma panel 70 normally includes a pair of support substrates 72 and 74, both of which can be fabricated from a glass such as commercial grade soda lime plate glass, or other similar glass. As is known, the substrate members 72 and 74 provide the majority of the mechanical panel strength and both faces of the panel must be capable of handling the lower gas pressure differential between the envelope and the environment across the face with minimal flexure. Because of the strength requirement, substrate members are the thickest components of the panel and together essentially define the overall thickness of the panel. The substrate members 72 and 74 are most often separated by a dielectric spacer (not shown) thereby maintaining the separation at the proper distance, as the exact separation between the two substrate members is critical and relatively small on the order of 5 mils. Additionally, the envelope is hermetically sealed around the perimeter with a dielectric sealant 75 (FIG. 2). Furthermore, in addition to providing the strength to form a rugged panel, the substrates, particularly in the large panels, also serve as heat sinks for dissipating the heat generated by the electrical discharge between the two electrodes. Thus, the heat transfer capability of the substrates is important to enhance the ability of the panel to function in environments subject to widely fluctuating temperatures. As is seen in FIG. 1, a number of column electrodes such as electrodes 76, 78 are normally provided and are positioned on substrate 72. A number of row electrodes 82 are normally provided and positioned on substrate 74. The spacing between the row electrodes and the column electrode is normally related to the desired resolution in the display raster. All of the electrodes are preferably fabricated from conductive material such as gold or aluminum and may be deposited on the substrates by numerous well known processes such as vacuum deposition, stencil screening, photo etching, or the like. Tin oxide or indium oxide can also be used for the fabrication of electrodes on the smaller panels because their higher resistance is still within acceptable limits and their transparent or semi-transparent characteristics are desirable. If the electrodes are fabricated from the more opaque materials, i.e. metals, the width of each individual electrode would normally be as narrow as reasonably possible so that the light discharged at each pixel site will not be blocked on its route through the substrate to the viewer.

Referring now to FIG. 2 which will show a more detailed view of the electrode construction. As may be seen in this FIGURE, the two support substrates 72 and 74 have deposited on their surfaces columnar electrodes 76 and 78 and a row electrode 82. Dielectric layers 83 and 84 are positioned on the substrate 72 and 74 respectively, thus coating the surface of each substrate and electrode. The material forming the dielectric layer is preferably selected so that its thermal expansion characteristics somewhat match the thermal expansion characteristics of the material forming the substrates. Each dielectric layer should be smooth without cracks, holes, dirt or other surface imperfections so that it will have a high and relatively constant breakdown voltage, i.e. on the order of one thousand (1,000) volts.

Typically, these materials will be made of silicon dioxide or other glass-like material which are conventional in this art. A second layer 88 is positioned on top of the dielectric layer and is typically formed of a good electron emissive material. Typically, these materials may be barium oxide or magnesium oxide, the magnesium oxide being the preferred and more typical material.

As would be expected, the dielectric material and the electrically emissive layer should be relatively transparent so that the light generated between the substrates is able to pass out to the viewer. As described above, the two substrates 72 and 74 are held apart from each other in part by a spacer (not shown) and define a closed envelope or chamber 86 which must be hermetically sealed by a dielectric sealant 75. The spacer (not shown) is sized and positioned between the two substrates to maintain a constant spacial separation between the sidewalls throughout the panel area and positioned not to cross any active pixel area.

In the manufacturing process, the chamber 86 is sealed around the outside edge and then evacuated so that the chamber can be filled with an ionizable gas. A number of gases or gas mixtures are known to be suitable as gaseous discharge medium for a plasma panel. These gases are gas mixtures which include neon with a minor amount of zenon or argon, helium or other noble gas. The most common gas mixture is referred to as a Penning mixture and comprises neon gas with about 0.1% by volume of argon.

Figure 3:
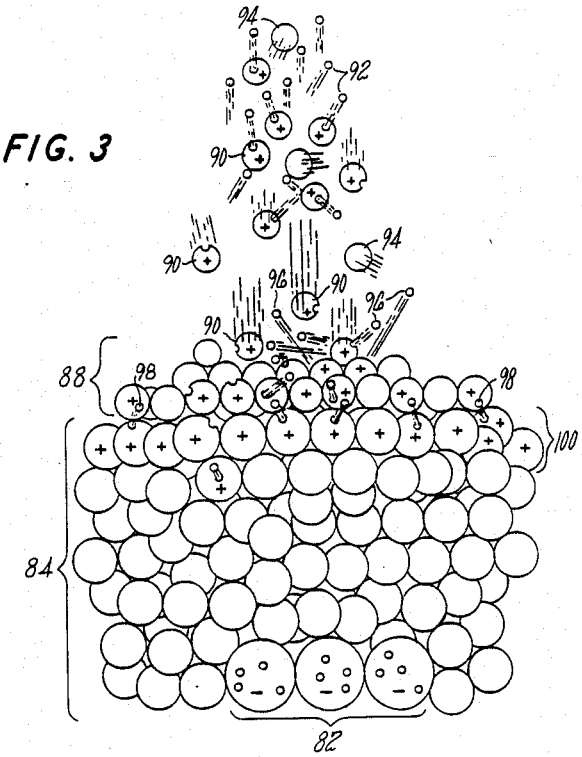
FIG. 3 is a simulated view at the molecular level of the prior art ionization activity at a pixel point.

As was stated in the Background Art, the problem addressed by this invention results from the activity which takes place at the negatively charged electrode site after discharge or ionization of the gas. The activity which takes place during this half cycle is shown on a molecular scale in FIG. 3. After the discharge and light pulse have taken place, the positive gas ions 90 which have been generated, migrate toward and contact with the electrically conductive emissive surface 88 of the negatively charged electrode 82. Upon contact with the surface, electrons 92 are transferred to the ions 90 converting the ions 90 to the uncharged gas atoms 94 which rejoin the gas in the envelope. The remaining ions 90 collide with the surface 88 generating new secondary electrons 96 that are drawn to the positively charged electrodes (not shown). As more and more electrons leave the emissive surface, the greater the positive charge generated on the surface. As the only source of replacement electrons in these prior art display panels, is the surface of the dielectric layer 84, electrons 98 from this layer 84 are caused to migrate through the emissive surface layer 88. This results in a positive charge being generated on the surface of the dielectric layer 84 directly under the emissive layer 88 which can freely and randomly spread across the surface of the dielectric material 100. This leads to the dilution of the wall charge as discussed in the "Background Art" section.

Figure 5:
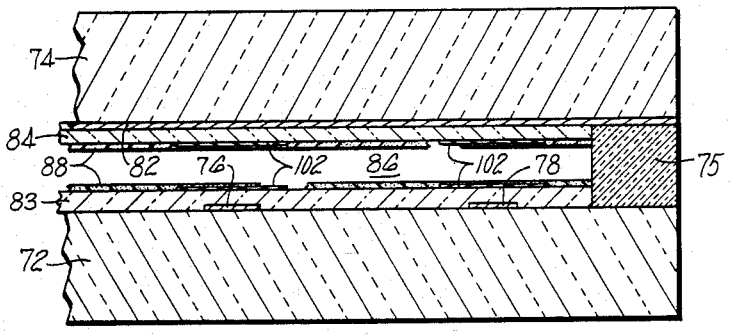
FIG. 5 is a partial cross-sectional view of an AC plasma display panel incorporating the present invention.
Figure 4:
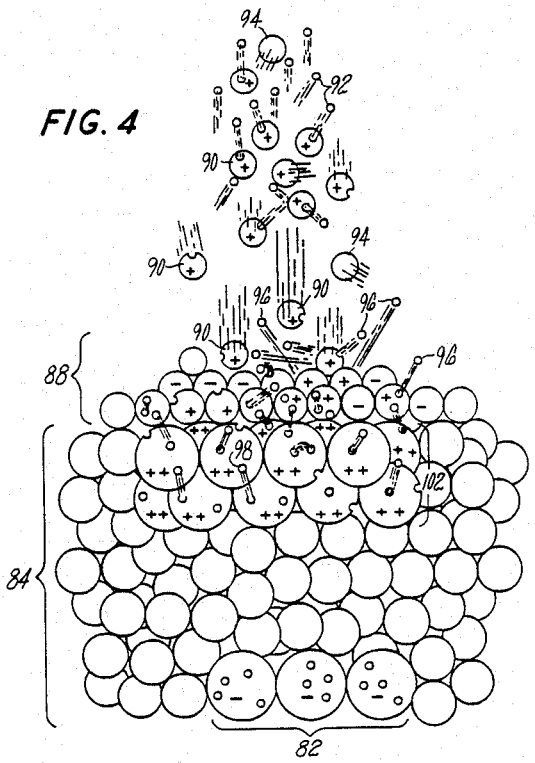
FIG. 4 is a simulated view at the molecular level of a pixel point of the present invention.

The present invention (as shown in cross section in FIG. 5 and on the molecular level in FIG. 4) prevents this charge spreading of the wall charge along the dielectric surface 84 by introducing into the surface of the dielectric material, about each electrode pixel site, a dopant material 102 which will possess the characteristic of having a lower work function (electrical conductivity) than the dielectric material 84 and the emissive layer 88, thereby having a tendancy to transfer electrons to the emissive layer 88 more freely than the dielectric substrate 84. The dopant material should be more electrically conductive than these two layers. The term dopant as used in this application means either a layer of material on the surface of the dielectric layer 84, or the introduction of the low work function material into the atomic structure of the dielectric layer. Since the time frame between half cycles is extremely short, and the easily available and plentiful source of electrons is confined to the geographic location of the dopant material, the charge is prevented from spreading outside of this geographic area, thereby concentrating the charge about the pixel point.

The dopant material 102 may be implanted using any of a number of known techniques, i.e. ion beam implantation, laser energy, evaporation of metals, sputtering, etc. The material 102 may be any number of transparent, electrically conductive materials having ionization energies (work function) below that of the dielectric material 84 and preferably the emissive layer 88. The two preferred materials are indium-tin oxide and aluminum or the same material which was used in the manufacture of the electrodes. This will result in the positive emissive layer acquiring its electron needs from the dopant material 102 rather than the dielectric surface 84. Preferably the material should be transparent in nature or at least transparent in the thicknesses required for this invention when deposited on the dielectric. However, if it is desired, an alternative approach may be to have the dopant material applied to the pixel points on one substrate of the panel as an opaque layer. This material will then act as a mirror and reflect the light pulse back to the viewer through the other substrate of the panel. This will enhance the brightness of the pixel point.

The preferred configuration, as shown in FIG. 7, describes the dopant 102' as distributed in a disk-like configuration with the pixel point 106 in the approximate center of the disk. Other configurations such as a square 102, FIG. 6, or a ring 102'', FIG. 8, of dopant material surrounding the pixel point may also be used. In each of these FIGS. 6, 7 and 8, a portion of a plasma display panel 70 is shown in which one or more pixel sites 106 are formed by the crossing of one column electrode 78 or 80 in perpendicular arrangement with a row electrode 82. The particular size of the dopant area implanted will be a function of the amount of dopant implanted, the distance between the pixel points and the time interval between pulses. It is desired that this surface area be as small as possible as this will allow for the greatest concentration of the wall charge. However, the longer the time between pulses, the greater the amount of electrons transferred and the greater the amount of electrons from the dopant is required. Generally, the dopant materials used should result in an implant having a resistivity of about 100 to 500 ohms equal to the bulk material.

In these FIGURES the dopant 102 is placed as a thin film about 300 to about 1000 angstroms thick with about 300 to about 500 angstroms being preferred. As the charge builds on the dopant surface due to the loss of electrons, the charge will tend to be evenly distributed about the dopant before sufficient energy is generated to exceed the work function of that required to remove electrons from the dielectric material and thereby further spread the charge. Therefore, if the half cycle is short enough and sufficient electrons are available from the dopant, then the wall charge created at the emissive layer pixel point will not spread further than the geographical perimeter defined by the dopant 102.

However, of particular note in FIG. 8 where the dopant forms an arc or ring about the pixel point, the charge spreading is reduced within this geographic area 108 because when the charge reaches the ring 102'', it is supplied with electrons from the ring restricting the charge to the geographic area within the ring.

Additionally, since this dopant material will have a low work function, it will be susceptible to sputtering if exposed to the ionized gas. Therefore, it is important to have the dopant material sufficiently covered by the emissive layer to minimize the sputtering and extend the life of the panel. This will typically be accomplished by assuring that the emissive layer fully covers the dopant area.

A number of advantages result from this modification to these type plasma panels in addition to the primary one of concentrating the wall charge.

First, the concentration of the wall charge will generate a visually brighter pixel point for the same level of voltage being applied to the electrode since more charge is available.

Secondly, since the wall charge will not be able to spread, it will have less influence on neighboring pixel points and in fact will allow the pixel points to be located closer to one another.

Thirdly, the dopant material will provide a rougher surface for the emissive layer providing more efficient electron emission.

Fourthly, the inventor permits gas plasma panel operation at higher frequencies due to diminished pixel crosstalk due to charge spreading.

It should be understood that the invention is not limited to the particular embodiments shown and described herein, but that various changes and modifications may be made without departing from the spirit and scope of this novel concept as defined by the following claims.

I claim:

1. A plasma display device comprising:

an ionizable gas disposed between two sidewalls of dielectric material, each sidewall having an inside surface closest to the ionizable gas, each inner surface having an array of electrodes disposed on the surface wherein the electrodes of one sidewall are positioned substantially perpendicular to the electrodes positioned on the other sidewall, thereby forming pixel points where they cross;

said electrodes and substrates being coated with a second dielectric layer;

said second dielectric layer coated with an electrically emissive material; wherein the improvement comprises an electrically conductive dopant material introduced into the second dielectric layer's surface adjacent to the emissive layer, said electrically conductive material being so configured about the electrode pixel point so as to concentrate the wall charge about said point and prevent said charge from spreading along the second dielectric's surface.

2. The article of claim 1 wherein the dopant is indium-tin oxide.

3. The article of claim 1 wherein the implanted material is configured as a circle, rectangle or square about the pixel point of the electrode.

4. The article of claim 1 wherein the dopant material has a bulk resistivity from about 300 to about 500 ohms per square.

5. The article of claim 3 wherein the implanted dopant acts as a reflective surface to increase the pixel brightness.

* * * * *